US006067769A

United States Patent [19]

Hardy

[11] Patent Number: 6,067,769

[45] **Date of Patent: *May 30, 2000**

[54] REINFORCING BRACE FRAME

[75] Inventor: Gary Hardy, Ventura, Calif.

[73] Assignee: Hardy Industries, Ventura, Calif.

[ * ] Notice: This patent is subject to a terminal disclaimer.

[21] Appl. No.: 08/966,002

[22] Filed: Nov. 7, 1997

[51] Int. Cl.[7] ..... E04C 3/02

[52] U.S. Cl. ..... 52/693; 52/295; 52/481.1; 52/693; 52/645; 52/641; 52/695; 52/696

[58] Field of Search ..... 52/693, 645, 641, 52/695, 696, 295, 481.1

[56] References Cited

U.S. PATENT DOCUMENTS

| | | | |
|---|---|---|---|
| 390,732 | 10/1888 | Weston . | |
| 1,622,962 | 3/1927 | Michod . | |
| 2,010,971 | 8/1935 | Thomson . | |
| 2,076,728 | 4/1937 | Keller . | |
| 2,089,023 | 8/1937 | Hahn . | |
| 2,124,519 | 7/1938 | Piersen et al. . | |
| 2,191,804 | 2/1940 | O'Malley . | |
| 2,365,175 | 12/1944 | Crawford | 52/693 |
| 2,514,607 | 7/1950 | McLean | 52/693 |
| 2,856,646 | 10/1958 | Latimer et al. . | |
| 2,963,127 | 12/1960 | Manville . | |
| 4,016,698 | 4/1977 | Rogers . | |
| 4,040,232 | 8/1977 | Snow et al. . | |
| 4,122,647 | 10/1978 | Kovar . | |
| 4,194,336 | 3/1980 | Weinar | 52/481 |
| 4,339,903 | 7/1982 | Menge . | |
| 4,370,843 | 2/1983 | Menge | 52/693 |
| 4,376,361 | 3/1983 | Michael | 52/241 |
| 4,563,851 | 1/1986 | Long . | |
| 4,619,098 | 10/1986 | Taylor | 52/738 |
| 4,637,195 | 1/1987 | Davis . | |
| 4,691,494 | 9/1987 | Gwynne | 52/729 |
| 4,742,645 | 5/1988 | Johnston | 49/372 |
| 4,794,746 | 1/1989 | Ramer . | |
| 4,809,476 | 3/1989 | Satchell | 52/241 |
| 5,105,598 | 4/1992 | Wilcox . | |
| 5,325,651 | 7/1994 | Meyer et al. | 52/715 |
| 5,390,455 | 2/1995 | Antolini | 52/299 |
| 5,392,573 | 2/1995 | Gould | 52/165 |
| 5,394,665 | 3/1995 | Johnson | 52/241 |
| 5,499,480 | 3/1996 | Bass . | |
| 5,609,006 | 3/1997 | Boyer | 52/731.9 |
| 5,664,388 | 9/1997 | Chapman et al. . | |
| 5,685,115 | 11/1997 | Colfer | 52/292 |
| 5,706,626 | 1/1998 | Mueller . | |
| 5,729,950 | 3/1998 | Hardy | 52/693 |
| 5,836,132 | 11/1998 | Weathersby | 52/702 |
| 5,904,025 | 5/1999 | Bass et al. . | |

*Primary Examiner*—Carl D. Friedman
*Assistant Examiner*—Jennifer I. Thissell
*Attorney, Agent, or Firm*—Lyon & Lyon LLP

[57] ABSTRACT

The reinforcing brace frame is utilized in building walls as a complete system of protection against both the severe shear stress and uplifting encountered during tornados, hurricanes and earthquakes. The reinforcing brace frame includes two vertically-spaced horizontally extending frame members joined at their opposite ends to two horizontally-spaced vertically extending frame members, and a diagonal member rigidly connected to opposite ends of the horizontally extending frame members. The reinforcing brace frame can also include spaced vertical support members between the vertical frame members. The reinforcing brace frame is directly attached to a concrete foundation by shear bolts and hold down bolts. Consequently, the reinforcing brace frame provides increased resistance against simultaneous shear stress and uplifting, eliminating the need for plywood shear panels.

10 Claims, 8 Drawing Sheets

REINFORCING BRACE FRAME

FIELD OF INVENTION

The present invention generally relates to structural reinforcement devices and more particularly to an improved system for protecting buildings against shear stress and uplifting.

BACKGROUND OF THE INVENTION

A large portion of the United States periodically suffers from earthquakes, tornados, or hurricanes. Low-level wooden buildings, including virtually all residential structures, are particularly susceptible to damage from these events. Consequently, even one such event can damage or destroy large numbers of wood-framed structures and their contents, causing billions of dollars of damage, displacing thousands of people from their homes, and seriously injuring or killing their occupants.

Earthquakes, tornados, and hurricanes destroy low-level wood-framed structures in two primary ways: creating high shear forces in the walls and uplifting the structure from its foundation. Lateral forces created by wind pressure or by seismic activity create substantial shear forces in the walls of the building which it would not normally experience. Further, the walls of a wood-framed building are generally weakest against shear loads. Consequently, violent shear forces can tear a standard wood-framed building apart. Uplifting of the building from its foundation also results from the abnormal atmospheric pressures and wind forces associated with tornados and hurricanes, and from the seismic motion of the ground during an earthquake.

Because of the significant damage and loss of life than can result from a tornado, hurricane, or earthquake, the Uniform Building Code (UBC) began to impose requirements in the 1970s for providing additional shear strength in the walls of low-level wood-framed structures. Originally, plywood shear panels nailed onto a wooden wall frame and attached to the building's base with hold-downs were used to provide the extra shear strength needed to meet the UBC requirements.

Plywood shear panels have several disadvantages. They take up a great amount of space and restrict the height to width ratio and design flexibility of buildings. This problem occurs because the plywood shear panels must be a certain size in order to comply with the strict strength requirements of the UBC. Additionally, the end vertical studs to which the plywood shear walls attach must be bulky 3×5 or 4×4 studs instead of the customary 2×4 studs in order to accommodate the nailing schedule used to attach the plywood shear wall to the skeletal frame. Builders using plywood shear panels must follow a complex nailing schedule and utilize a specific type of nail to meet those requirements. A large amount of time and skilled labor is required to hammer in all of the nails that are required by the prior art, adding to construction time and expense. In addition, significant inspection time is required to ensure that the proper nailing schedule and nail type were used, adding to construction time and placing a burden on city building inspectors.

Hold-downs were used along with plywood shear panels to provide the necessary shear strength and address the problem of uplifting. Two primary types of hold-down were used. The first consisted of a bolt that attached the plywood shear wall to a bottom plate, which is then attached to the foundation. L-shaped braces were also used to attach the end vertical studs to the bottom plates; those braces were then attached in turn to the foundation. Neither of these methods directly attaches the shear wall to the foundation. Rather, a bottom plate intermediates between the two, creating a failure point. As the structure ages, a wooden bottom plate may deteriorate for several reasons. The constant pressure of the structure on the wooden bottom plate for year after year can crush or compress it. Insects such as termites can attack and destroy the wooden bottom plate. As the wood dries out, it can shrink or become brittle. Consequently, as the wooden bottom plate ages and deteriorates, the hold-down nut remains stationary on the hold-down bolt, forming a gap between the nut and the wooden bottom plate. Such a loosened hold-down loses much of its effectiveness for uplift resistance. Further, because these hold-downs were not attached in line with the uplift forces, they were subject to significant moment forces during uplift, creating extra strain on the hold-downs and increasing the likelihood of failure.

SUMMARY OF THE INVENTION

The present invention provides an reinforcing brace frame in a stud wall.

In a first, separate aspect of the present invention, a frame structure is contemplated including a stud wall, a foundation, and a reinforcing brace frame. The reinforcing brace frame includes two horizontally-extending frame members, two vertically-extending frame members, a diagonal frame member, and at least two slots bolted to the foundation. The reinforcing brace frame satisfies the requirements of the UBC, and of building codes in high-risk areas like Los Angeles, for shear resistance in wood-framed buildings. The installation of several reinforcing brace frames in a wood-framed structure obviates the need for expensive plywood shear panels that require significant time to construct and inspect. The reinforcing brace frame provides a unitary solution to the problems of shear stress and uplift. At the same time that it reinforces a structure against severe shear stress, the reinforcing brace frame protects it from uplift through its direct integration with the structure's concrete foundation by means of shear bolts and hold down bolts.

In a second, separate aspect of the present invention, a unitary vertically-extending member with an upper frame member and a lower frame member on either end thereof. The unitary member is an open section forming a semi-enclosed rectangular space. This structural device is of particular utility in small wall areas such as to either side of a garage door.

Accordingly, it is an object of the present invention to provide an improved reinforcing brace frame structure. Other and further objects and advantages will appear hereinafter.

DETAILED DESCRIPTION

Figure 1:
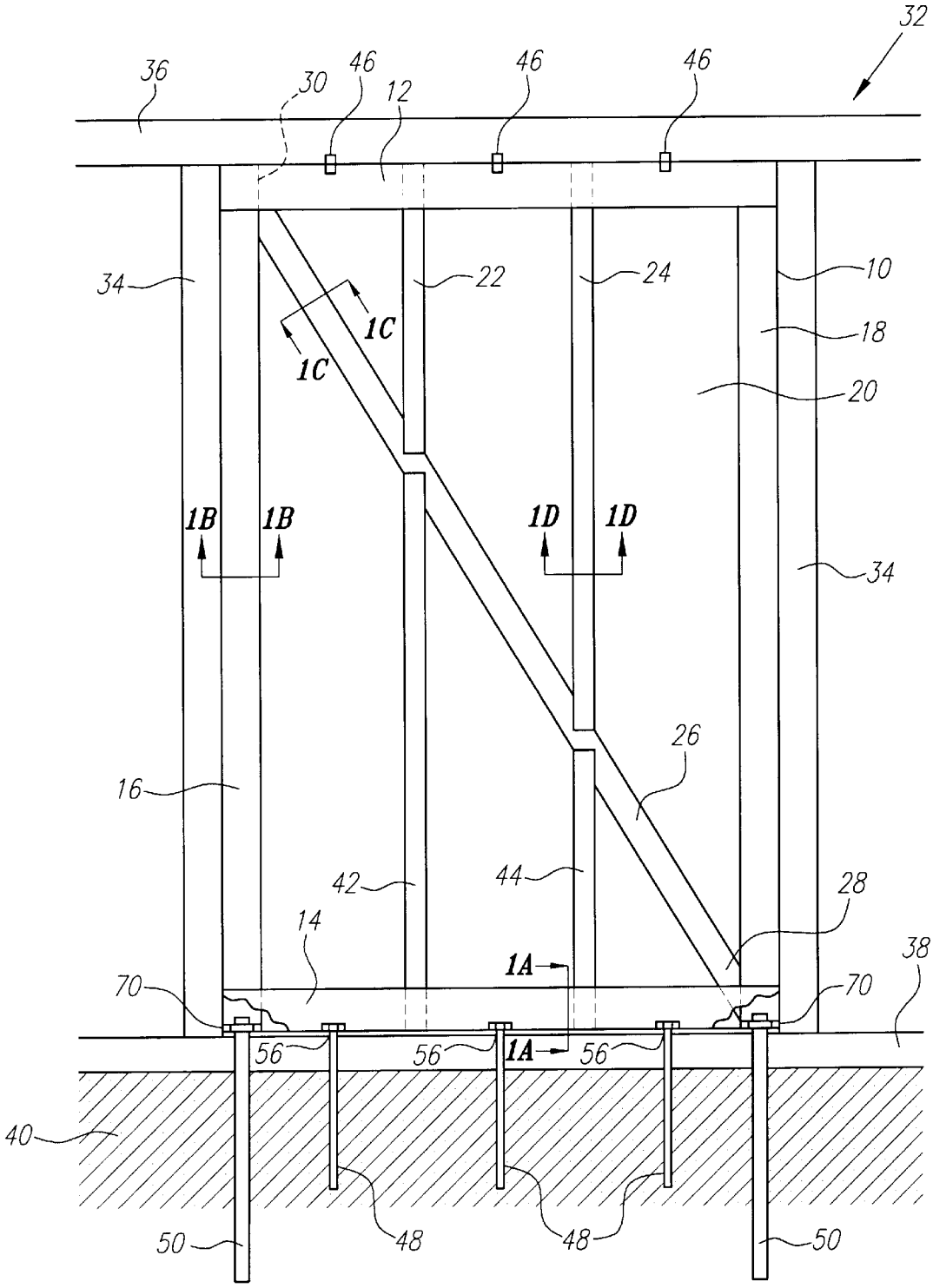
FIG. 1 is a front elevation of a preferred embodiment of the reinforcing brace frame of the present invention, shown secured in a building wall to studs, top and bottom plates.

Now referring more particularly to FIG. 1 of the accompanying drawings, a first preferred embodiment of the reinforcing brace frame of the present invention is schematically depicted therein.

Figure 1A:
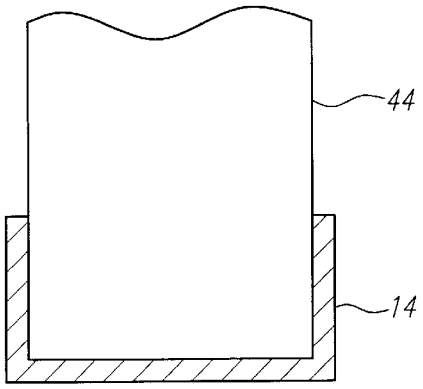
FIG. 1A is a cross-sectional view of a horizontal support member.
Figure 1B:
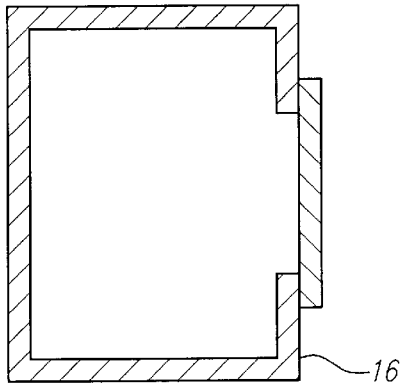
FIG. 1B is a cross-sectional view of a vertical support member.

Thus, a first preferred embodiment of an reinforcing brace frame 10 is shown which includes a vertically spaced pair of horizontal frame members, the top member 12 and the bottom member 14. The opposite ends of both the top member 12 and the bottom member 14 are rigidly connected, preferably by welding, to a laterally spaced pair of vertical frame members, the left member 16 and the right member 18, to form therewith an open rectangular box 20. While the rigid connection between members is preferably accomplished by welding, any method of rigid connection may beused, such as, e.g., brazing or bolting. Preferably, the top member 12 and the bottom member 14 possess a "U"-shaped cross-section, as shown in FIG. 1A, but any other cross-section that provides adequate strength may be used. Preferably, the top member 12 is oriented such that the open portion of the "U"-shaped cross-section is directed downward. Preferably, the bottom member 14 is oriented such that the open portion of the "U"-shaped cross-section is directed upward. Preferably, the left member 16 and the right member 18 possess a "C"-shaped cross-section, as shown in FIG. 1B, where the opening in each "C" section has been welded closed to form an enclosed hollow member, but any other cross-section that provides adequate strength may be used. The left member 16 and the right member 18 are oriented such that the open portion of the "C"-shaped cross section that has been welded shut is facing away from the center of the reinforcing brace frame 10.

Figure 1C:
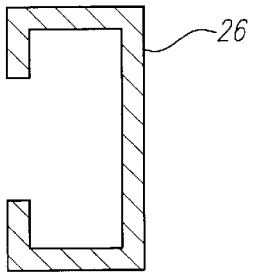
FIG. 1C is a cross-sectional view of an additional vertical member.

The reinforcing brace frame 10 also includes a diagonal support member 26, the opposite ends 28 and 30 of which are rigidly connected, preferably by welding, to the top member 12 and the bottom member 14, and to the left member 16 and the right member 18, at opposite corners of rectangular box 20. While the rigid connection between members is preferably accomplished by welding, any method of rigid connection may be used, such as, e.g., brazing or bolting. Preferably, diagonal support member 26 possesses a "C"-shaped cross-section, as shown in FIG. 1C, but any other cross-section that provides adequate strength may be used.

Figure 1D:
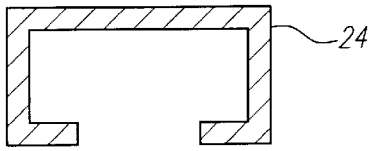
FIG. 1D is a cross-sectional view of the diagonal support member.

Preferably, the reinforcing brace frame 10 includes two additional vertical support members, the first additional vertical member comprising a first upper member 22 and a first lower member 42, and the second additional vertical member comprising a second upper member 24 and a second lower member 44. More than two such additional vertical members may be used as needed. The first upper member 22 is rigidly connected at one end to top member 12 and rigidly connected at the opposite end to diagonal member 26. The first lower member 42 is located directly below and in line with the first upper member 22. The first lower member is rigidly connected at one end to the diagonal member 28 and rigidly connected at the opposite end to the bottom member 14. The second upper member 24 is rigidly connected at one end to the top member 12 and rigidly connected at the opposite end to the diagonal member 26. The second lower member 44 is located directly below and in line with the second upper member 24. The second lower member 44 is rigidly connected at one end to the diagonal member 28 and rigidly connected at the opposite end to the bottom member 14. Preferably, these rigid connections are accomplished by welding, but any rigid connection may be used, such as, e.g., bolting or brazing. Preferably, the first upper member 22, the first lower member 42, the second upper member 24, and the second lower member 44 possess a "U"-shaped cross-section, as shown in FIG. 1D, but any other cross-section that provides adequate strength may be used. Preferably, the first upper member 22 and the first lower member 42 are oriented such that the open portion of the first upper member 22 is directed in the opposite direction as the open portion of the first lower member 42 such that the first upper member 22 and the first lower member 42 cooperatively resist shear loading. Preferably, the second upper member 24 and the second lower member 44 are oriented such that the open portion of the second upper member 24 is directed in the opposite direction as the open portion of the second lower member 44 such that the second upper member 22 and the second lower member 42 cooperatively resist shear loading.

Preferably, the reinforcing brace frame 10 is composed of steel, but wood or other metal, or a combination, of sufficient strength may be used. Thus, the reinforcing brace frame 10 forms a self-contained strong, rigid unit resistant to shear stress which can be directly incorporated into a framed wall to substantially increase the resistance of the wall to collapse during tornados, hurricanes and earthquakes.

Figure 5:
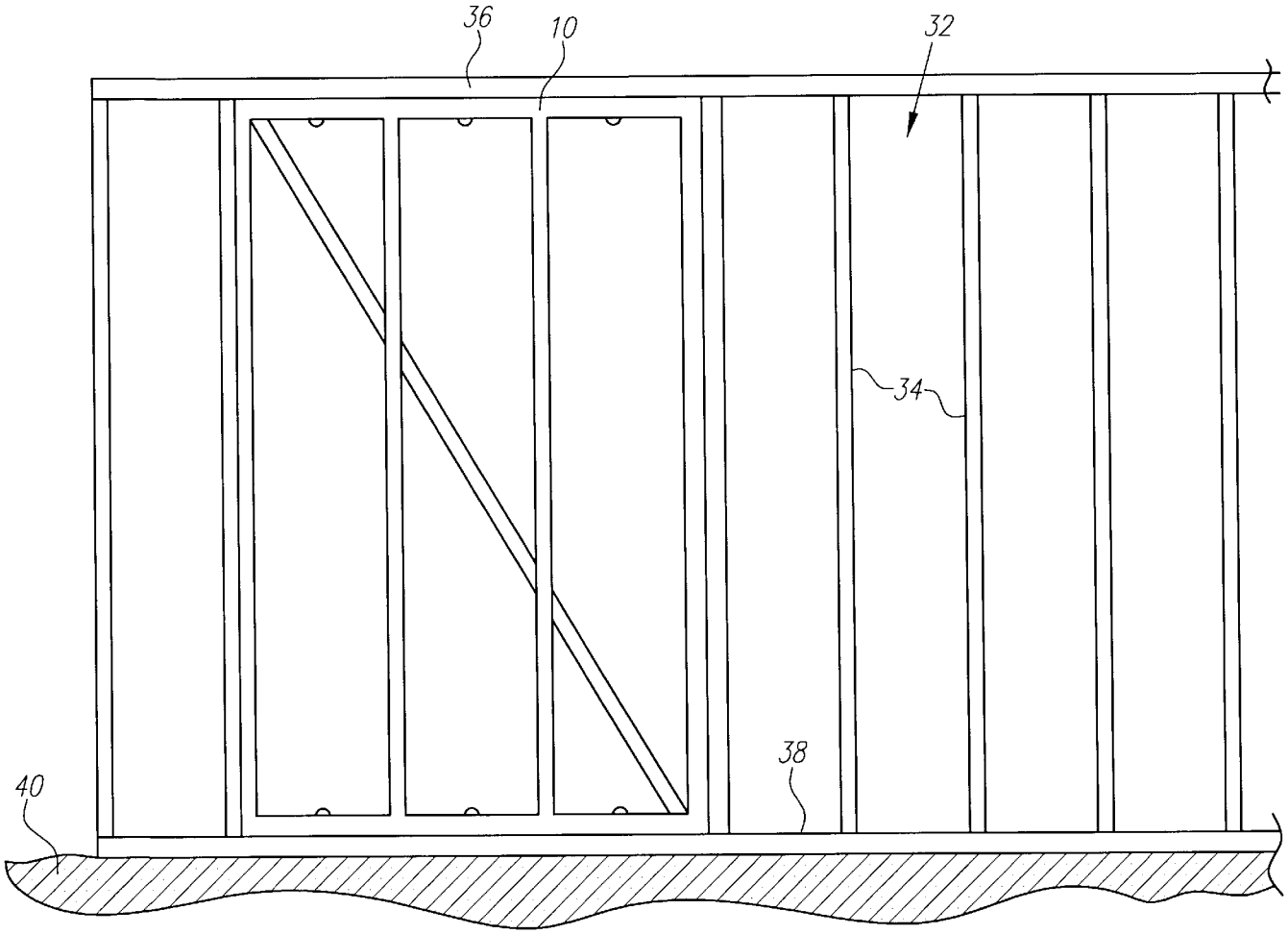
FIG. 5 is a reinforcing brace frame in a stud wall.

FIG. 1 shows the reinforcing brace frame 10 secured in place in the framing of a stud wall 32 comprising vertical studs 34, a sill 36 and a base 38 above a concrete foundation 40. FIG. 5 shows an alternate view of the reinforcing brace frame 10 secured in place in a stud wall 32 comprising vertical studs 34, a sill 36 and a base 38 above a concrete foundation 40, showing a typical installation of the reinforcing brace frame 10. Preferably, the reinforcing brace frame 10 is secured to the foundation by shear bolts 48 and hold down bolts 50. The hold down bolts 50 pass through a washer 70, then through slots 56 in the bottom member 14 through a base 38 directly into a concrete foundation 40. The washer 70 is positioned within the open channel of the bottom member 14, within the semi-enclosed space defined by either left member 16 or right member 18. The washer 70 is rectangular in shape, and is made from steel.

Figure 1E:
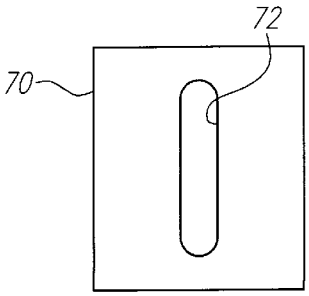
FIG. 1E is a top view of the washer.

FIG. 1E shows a top view of the washer 70. The washer 70 contains a slot 72 oriented such that its longer dimension runs perpendicular to the plane defined by the reinforcing brace frame 10. The slot 72 preferably possesses semicircular ends and a substantially rectilinear portion therebetween. The slots 56 in the bottom member 14 possess the same size and shape. The washers 70 are positioned such that the slot 72 in each washer is located directly above a corresponding slot 56 in the bottom member 14. Further, each washer 70 is oriented such that each slot 72 and each slot 56 are directionally aligned. The orientation and shape of the slot 72 and the slots 56 allow construction personnel to adjust the alignment of the reinforcing brace frame 10 to ensure it is substantially parallel to the wood frame wall it is located within.

The shear bolts 48 pass through the base 38 and penetrate a sufficient distance into the concrete foundation 40 to prevent the reinforcing brace frame 10, and the stud wall 32 to which it is secured, from sliding during severe shear stress. Preferably, three shear bolts 48 are used, but additional shear bolts 48 may be used in a specific installation if needed. The hold down bolts 50 pass through the base 38 and penetrate a sufficient distance into the concrete foundation 40 to prevent uplifting of the reinforcing brace frame 10 and consequently of the building itself. Preferably, two hold down bolts 50 are used, with one hold down bolt 50 centered in line with the left member 16 and another hold down bolt 50 centered in line with the right member 18, but additional slots 56 and hold down bolts 50 may be used in a specific installation if needed. Centering the hold down bolts 50 with respect to the longitudinal centerline of both the left member 16 and the right member 18 places the hold down bolts 50 in line with uplift forces, thereby minimizing the moment force experienced by the hold down bolts 50 during uplift.

The reinforcing brace frame 10 is also secured to the sill 36. Preferably, the reinforcing brace frame 10 is secured to the sill 36 by screws 46, but any other connectors or connection methods possessing the required strength may be used. The number of screws 46 used is dependent on the specific installation of the reinforcing brace frame 10.

FIG. 1A shows the preferred "U"-shaped cross-sectional structure of the top member 12 and the bottom member 14.

FIG. 1B shows the preferred closed "C"-shaped cross-sectional structure of the left member 16 and the right member 18.

FIG. 1C shows the preferred "C"-shaped cross-sectional structure of the first upper member 22, the first lower member 42, the second upper member 24, and the second lower member 44.

FIG. 1D shows the preferred "C"-shaped cross-sectional structure of the diagonal member 26.

Figure 1F:
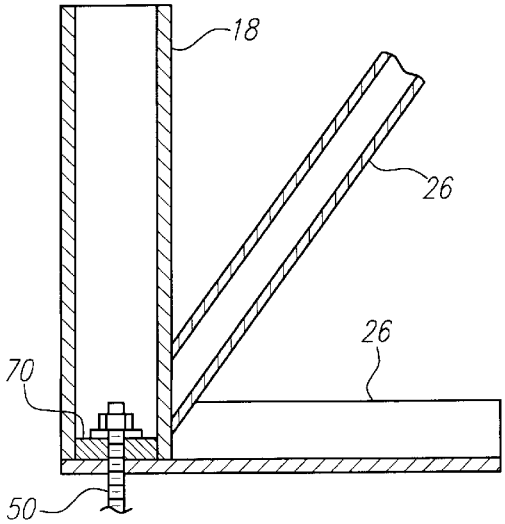
FIG. 1F is a detail of a corner of the reinforcing brace frame.

FIG. 1F shows a corner of the reinforcing brace frame in detail.

Figure 2:
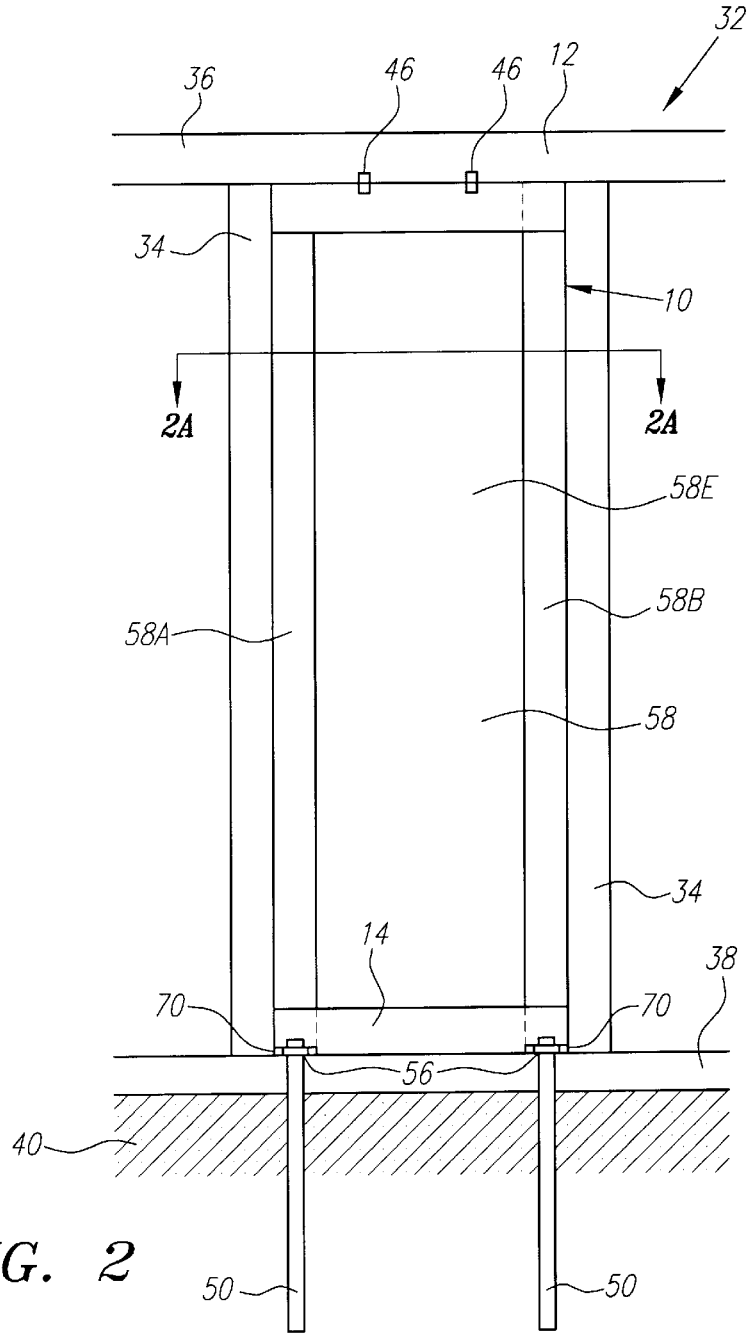
FIG. 2 is a front view of an second embodiment of the reinforcing brace frame.
Figure 2A:
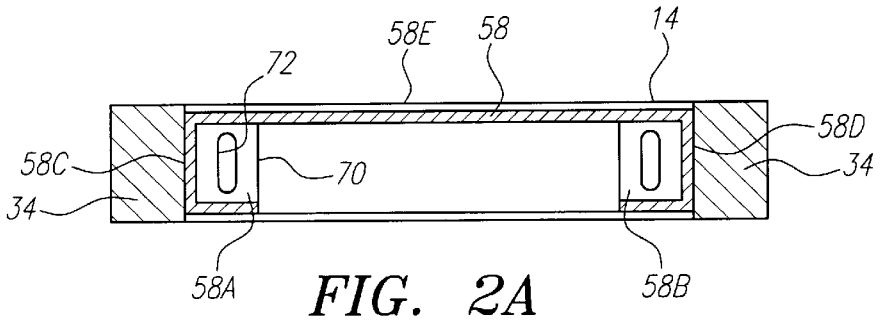
FIG. 2A is a cross-sectional view of the unitary vertical support member in the second embodiment of the reinforcing brace frame.

A second preferred embodiment of the reinforcing brace frame 10 is shown in FIG. 2. This embodiment is advantageously used in smaller and narrower spaces in a wall to be reinforced, such as, e.g., a short wall on either side of a garage door. This second embodiment includes a vertically spaced pair of horizontal frame members, the top member 12 and the bottom member 14. Preferably, the top member 12 and the bottom member 14 each possess a "U"-shaped cross-section. The top member 12 is oriented such that the open portion of the "U"-shaped cross-section is directed downward, and the bottom member 14 is oriented such that the open portion of the "U"-shaped cross-section is directed upward.

A vertical member 58 is formed from a single sheet of metal bent twice along both its left edge and its right edge such that the left and right sides of the vertical member 58 each form an open rectangular semi-closed space as shown in FIG. 2 with inwardly extending flanges 58A and B, end panels 58C and D and an interconnecting flat web 58E. The vertical member 58 is sized such that it fits into the open portion of both the top member 12 and the bottom member 14. The vertical member 58 is rigidly connected to the top member 12 and the bottom member 14, preferably by welding. Two washers 70 are rigidly connected to the bottom member 14, preferably by tack welding. These washers are sized such that they fit atop the bottom member 14 within the space defined by the open rectangular semi-closed portions of the vertical member 58. As with the first preferred embodiment, the washers 70 are oriented such that the slot 72 in each washer 70 is aligned with its corresponding slot 56 on the bottom member 14.

By disposing the top and bottom ends of the vertical member 58 within the open portion of the top member 12 and the bottom member 14, and rigidly connecting the vertical member 58 to the top member 12 and the bottom number 14, the vertical member 58 gains significant rigidity. The top member 12 and the bottom member 14 constrain the ends of the vertical member 58 and thereby increase the resistance of the vertical member 58 to shear and torsion. Due to this interaction among the vertical member 58, the top member 12, and the bottom member 14, the second embodiment of the reinforcing brace frame 10 can withstand shear loads at least as great as the requirements imposed by the UBC, without the need for a diagonal member 26.

FIG. 2 shows the second embodiment of the reinforcing brace frame 10 secured in place in the framing of a stud wall 32 comprising vertical studs 34, a sill 36 and a base 38 above a concrete foundation 40. Preferably, the reinforcing brace frame 10 is secured to the foundation by hold down bolts 50. The hold down bolts 50 pass through a washer 70, then through slots 56 in the bottom member 14 through a base 38 directly into a concrete foundation 40. The washer 70 is positioned within the open channel of the bottom member 14, within the semi-enclosed space defined by either left member 16 or right member 18.

The hold down bolts 50 penetrate a sufficient distance into the concrete foundation 40 to prevent uplifting of the reinforcing brace frame 10 and consequently of the building itself. Preferably, two hold down bolts 50 are used, with one hold down bolt 50 centered in line with the open rectangular space on the left edge of the vertical member 58 and another hold down bolt 50 centered in line with the open rectangular space on the right edge of the vertical member 58, but additional slots 56 and hold down bolts 50 may be used in a specific installation if needed. Centering the hold down bolts 50 with respect to the longitudinal centerlines of the open rectangular spaces at the left and right edges of vertical member 58 places the hold down bolts 50 in line with uplift forces, thereby minimizing the moment force experienced by the hold down bolts 50 during uplift. In this embodiment, the hold down bolts 50 also act as shear bolts, resisting shear forces as well as uplift.

The reinforcing brace frame 10 is also secured to the sill 36. Preferably, the reinforcing brace frame 10 is secured to the sill 36 by screws 46, but any other connectors or connection methods possessing the required strength may be used. The number of screws 46 used is dependent on the specific installation of the reinforcing brace frame 10.

Figure 3:
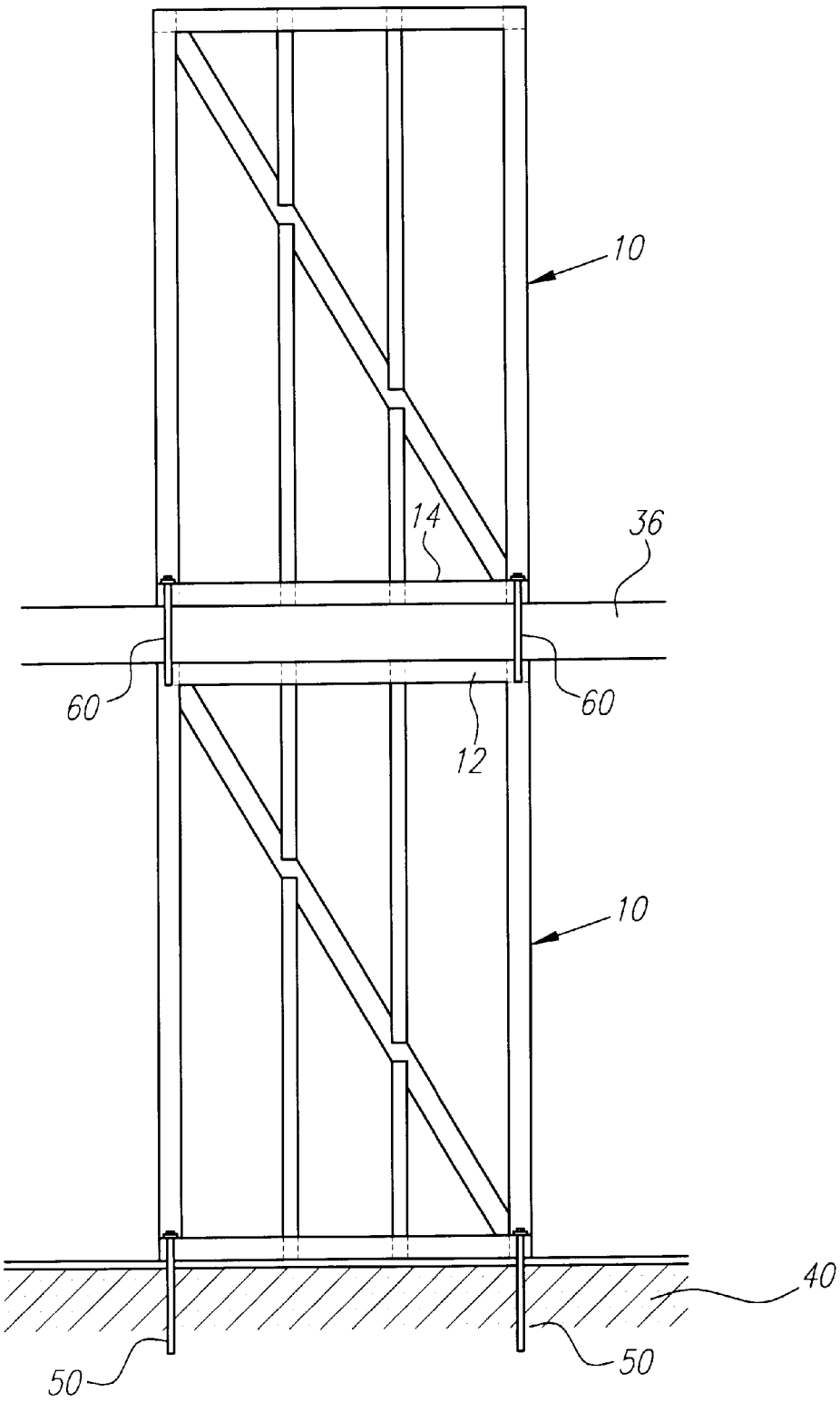
FIG. 3 is a front elevation of two reinforcing brace frames stacked and connected together top to bottom with bolts.

As shown in FIG. 3, a plurality of brace frames 10, if desired, can be stacked on top of one another, and can be welded, bolted or otherwise permanently connected together to reinforce a multi-story building. For such purposes, the top member 12 of the lower reinforcing brace frame 10 and the bottom member 14 of the upper reinforcing brace frame 10 can be aligned for placing bolts 60 through both vertically stacked reinforcing brace frames. The two reinforcing brace frames 10 are aligned such that the bolts 60 are in line with the hold down bolts 50 which secure the lower reinforcing brace frame 10 to the foundation 40. Preferably, the lower reinforcing brace frame 10 and the upper reinforcing brace frame 10 are separated by a sill 36 through which the bolts 60 pass. The direct connection between the reinforcing brace frames 10 enables the connected reinforcing brace frames 10 to resist shear and uplift forces as a single unit.

Figure 3A:
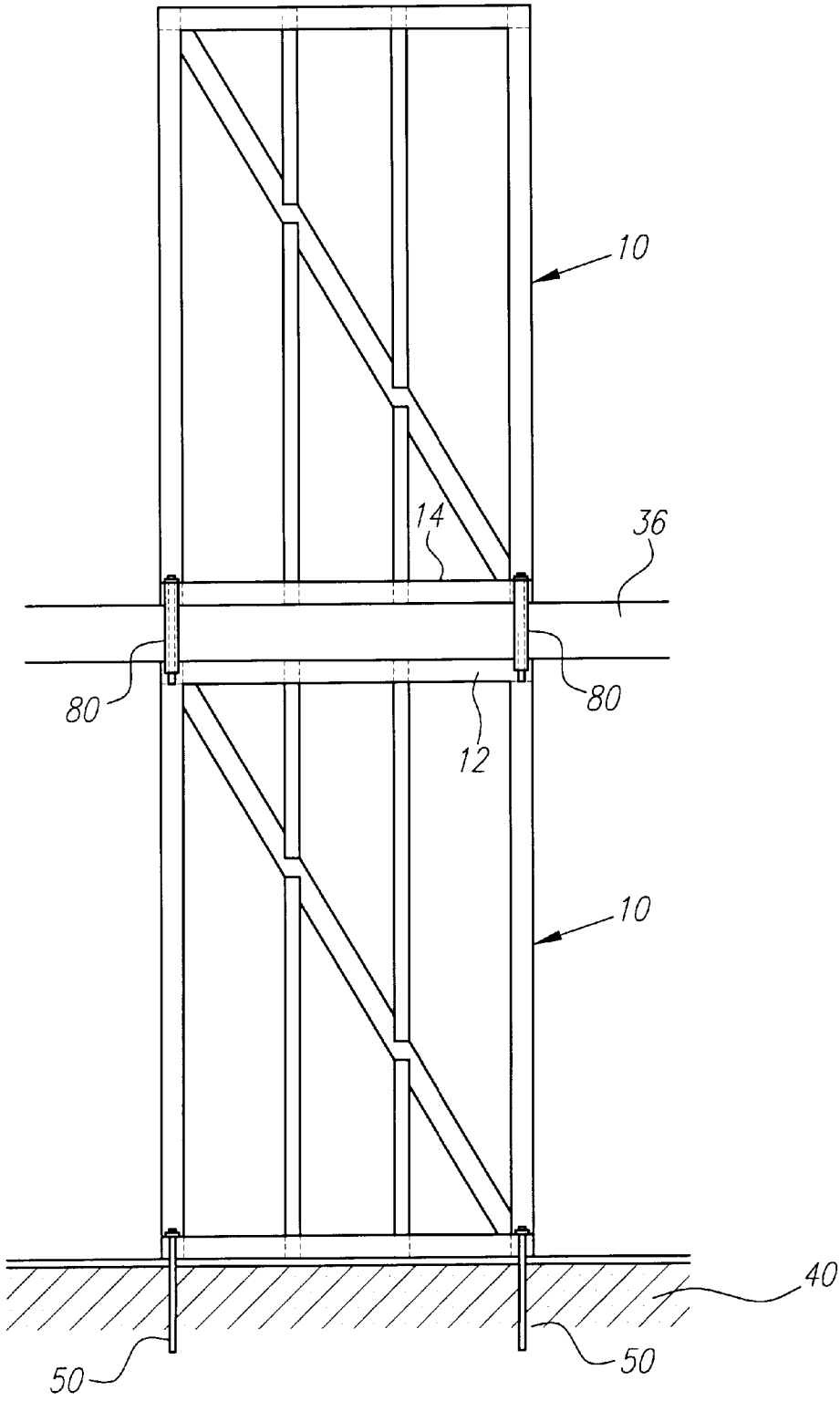
FIG. 3A is a front elevation of two reinforcing brace frames stacked and connected together top to bottom with metal straps.

In an alternate embodiment shown in FIG. 3A, metal straps 80 are used to directly connect the stacked reinforcing brace frames 10. Preferably, the strap 80 is welded to both reinforcing brace frames 10, but any rigid connection may be used, such as, e.g., bolting.

The stacked reinforcing brace frames 10 may be separated by other types of structural member so long as they are directly connected; for example, by bolts 60 passing through a joist from one reinforcing brace frame 10 to the other. Further, more than two reinforcing brace frames 10 may be stacked together.

Figure 4:
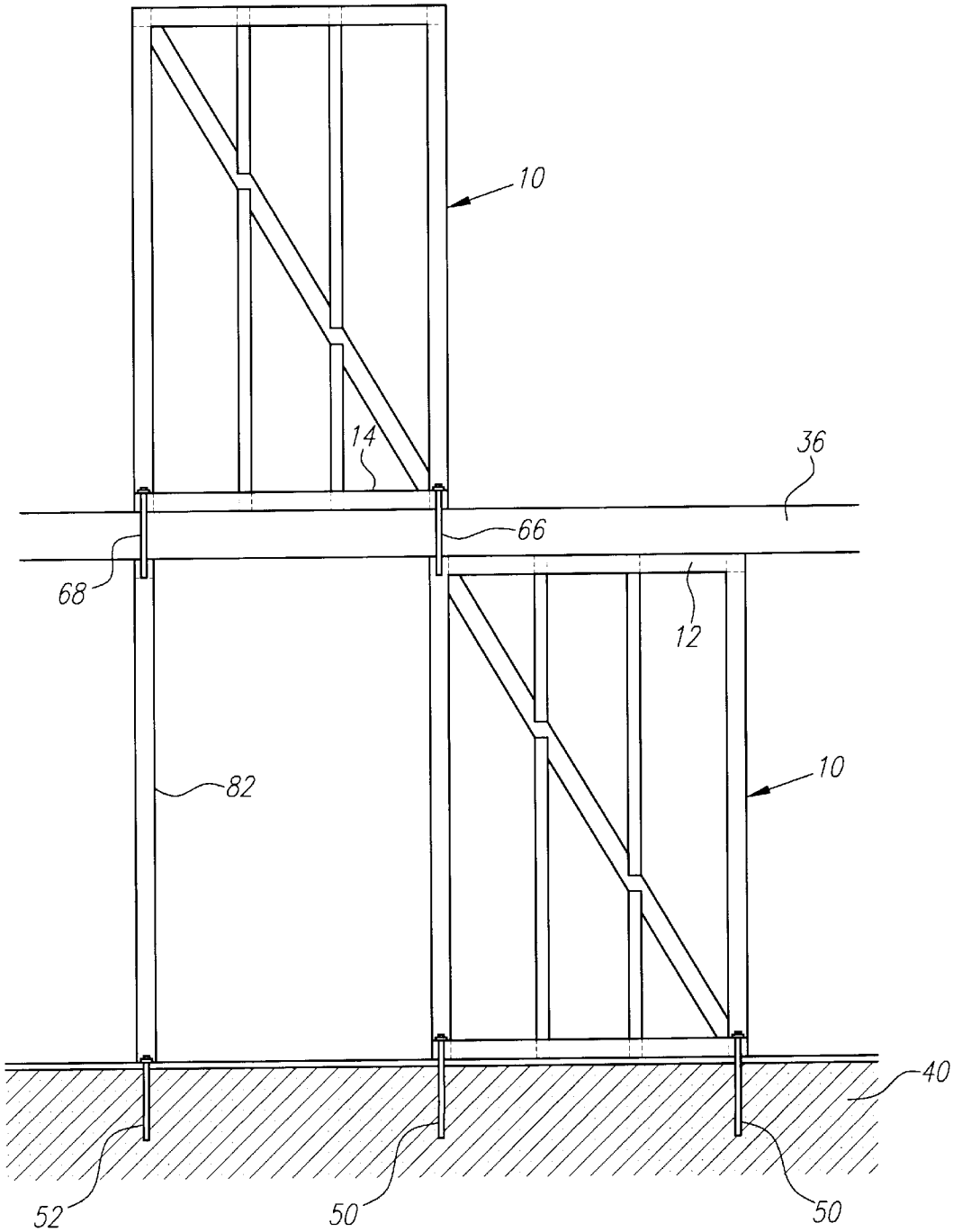
FIG. 4 is a front elevation of two reinforcing brace frames staggered and connected together top to bottom with a bolt.

As shown in FIG. 4, a plurality of brace frames 10 may be stacked together in a staggered fashion. The top member 12 of the lower reinforcing brace frame 10 is aligned with the bottom member 14 of the upper reinforcing brace frame 10 such that a bolt 66 can be placed downward from a bottom corner of the upper reinforcing brace frame 10 to the opposite top corner of the lower reinforcing brace frame 10. The two reinforcing brace frames 10 are aligned such that the bolt 66 is in line with one of the hold down bolts 50 which secure the lower reinforcing brace frame 10 to the foundation 40. Preferably, the lower reinforcing brace frame 10 and the upper reinforcing brace frame 10 are separated by a sill 36 through which the bolt 66 passes.

Figure 4A:
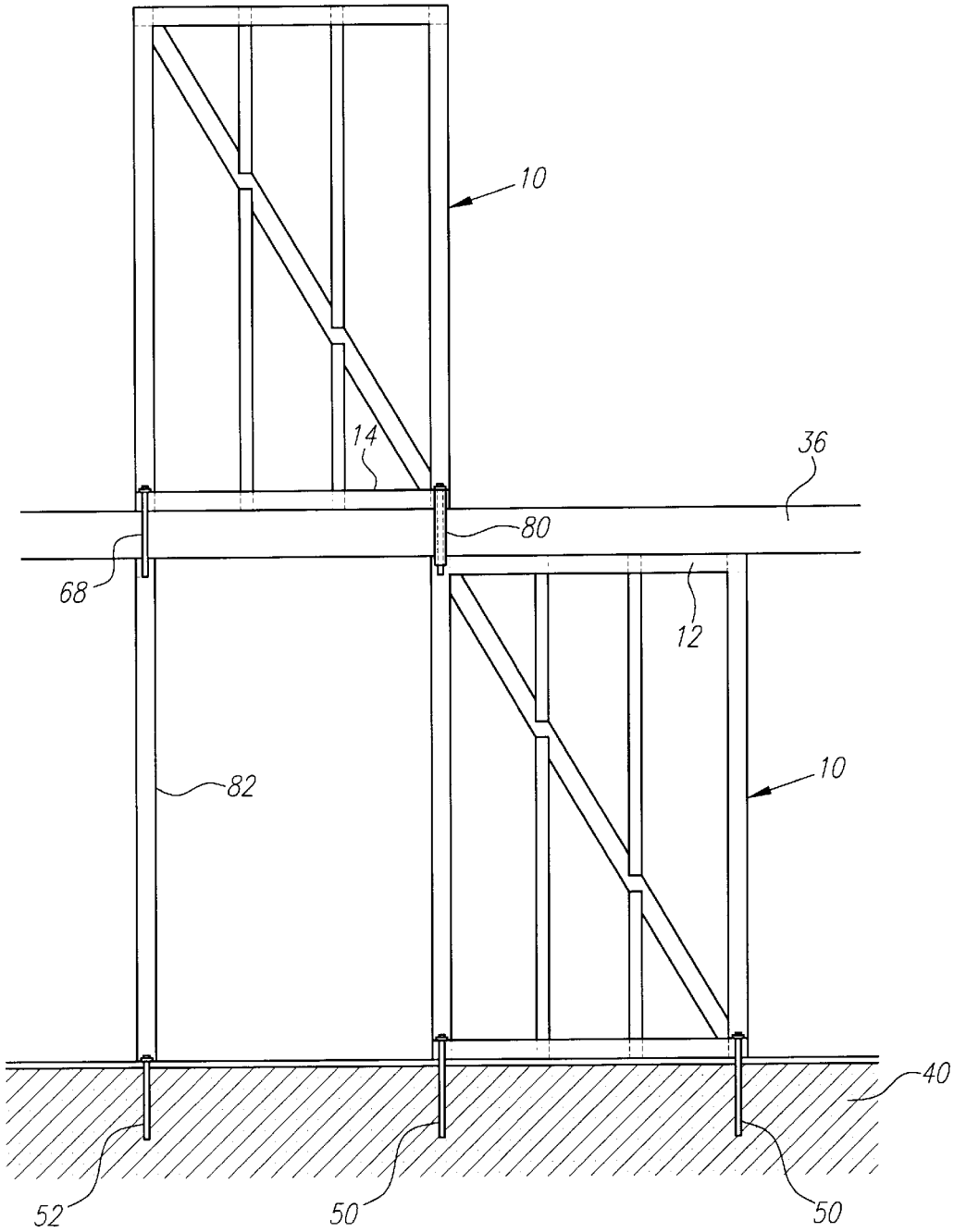
FIG. 4A is a front elevation of two reinforcing brace frames staggered and connected together top to bottom with a metal strap.

In an alternate embodiment shown in FIG. 4A, a metal strap 80 is used to directly connect the staggered reinforcing brace frames 10. Preferably, the strap 80 is welded to both reinforcing brace frames 10, but any rigid connection may be used, such as, e.g., bolting.

The staggered reinforcing brace frames 10 may be separated by other types of structural member so long as they are directly connected; for example, by a bolt 66 passing through a joist from one reinforcing brace frame 10 to the other. The other lower corner of the upper reinforcing brace frame 10 is connected by a bolt 68 to a wall framing member 82. The wall framing member 82 is directly connected to the foundation 40 by hold down bolt 52. The wall framing member 82 is aligned with the upper reinforcing brace frame 10 such that the bolt 68 is in line with the hold down bolt 52. More than two reinforcing brace frames 10 may be staggered in this manner.

An reinforcing brace frame and many of its attendant advantages have thus been disclosed. It will be apparent, however, that various changes may be made in the form, construction, and arrangement of the parts without departing from the spirit and scope of the invention, the form hereinbefore described being merely a preferred or exemplary embodiment thereof. Therefore, the invention is not to be restricted or limited except in accordance with the following claims.

I claim:

1. A frame structure, comprising:

a stud wall;

a foundation supporting the stud wall;

a reinforcing brace frame positioned coplanar with and in the stud wall and including a bottom horizontally-extending frame member, a top horizontally-extending frame member vertically spaced from the bottom horizontally-extending frame member, two vertically-extending horizontally-spaced frame members rigidly connected to opposite ends of the horizontally-extending frame members to form a rectangular frame, at least one diagonal member rigidly connected to opposite corners of the rectangular frame, and at least two slots in the bottom horizontally-extending frame member; and bolts extending from the foundation and attached to the reinforcing brace frame.

2. The reinforcing brace frame of claim 1, wherein the slots are shorter in the dimension oriented along the horizontally-extending frame members and longer in the dimension oriented perpendicular to the plane defined by the horizontally-extending and vertically-extending frame members.

3. The reinforcing brace frame of claim 1, wherein the reinforcing brace frame may be stacked atop at least one other reinforcing brace frame with a rigid connection directly therebetween.

4. The reinforcing brace frame of claim 1 further comprising at least two of said reinforcing brace frame, the reinforcing brace frames being stacked one atop the other to define an upper reinforcing brace frame and a lower reinforcing brace frame, the top horizontally-extending member of the lower reinforcing brace frame including attachment holes therethrough;

a rigid connection extending between the stacked reinforcing brace frames including connectors which pass through the slots provided in the bottom horizontal member of the upper reinforcing brace frame, through any intervening building structure, and through the attachment holes of the lower reinforcing brace frame.

5. The reinforcing brace frame of claim 1 further comprising at least two of said reinforcing brace frame, the reinforcing brace frames being stacked one atop the other to define an upper reinforcing brace frame and a lower reinforcing brace frame;

a rigid connection extending between the stacked reinforcing brace frames including metal straps rigidly connected to the vertically-extending frame members of the upper reinforcing brace frame, respectively, and to the corresponding vertically-extending frame members of the lower reinforcing brace frame, respectively.

6. The reinforcing brace frame of claim 1, wherein the reinforcing brace frame may be staggered atop at least one other reinforcing brace frame with a rigid connection directly therebetween.

7. The reinforcing brace frame of claim 1 further comprising at least two of said reinforcing brace frame, the reinforcing brace frames being staggered atop one another to define an upper reinforcing brace frame and a lower reinforcing brace frame, the top horizontally-extending member of the lower reinforcing brace frame including attachment holes therethrough;

a rigid connection extending between the stacked reinforcing brace frames including a connector which passes through one of the slots in the bottom horizontally-extending member of the upper reinforcing brace frame, through any intervening building structure, and through a corresponding attachment hole in the top horizontally-extending member of the lower reinforcing brace frame.

8. The reinforcing brace frame of claim 1 further comprising at least two of said reinforcing brace frame, the reinforcing brace frames being staggered atop one another to define an upper reinforcing brace frame and a lower reinforcing brace frame, the top horizontally-extending member of the lower reinforcing brace frame including attachment holes therethrough;

a rigid connection extending between the staggered reinforcing brace frames including a metal strap rigidly connected to one of the vertically-extending frame members of the upper reinforcing brace frame and to the opposite one of the vertically-extending frame members of the lower reinforcing brace frame.

9. The frame structure of claim 1, wherein the reinforcing brace frame further comprises one or more additional vertical support members, each such vertical support member comprising an upper member and a lower member, wherein the upper member is rigidly connected to the top horizontally-extending frame member and to the diagonal member, and the lower member is rigidly connected to the bottom horizontally-extending frame member and to the diagonal member.

10. The frame structure of claim 9, wherein each upper member possesses a "U"-shaped cross section oriented in a first direction and each corresponding lower member possesses a "U"-shaped cross section oriented in a second, opposite direction.

* * * * *